US007771243B2

(12) United States Patent
Peterson et al.

(10) Patent No.: US 7,771,243 B2
(45) Date of Patent: Aug. 10, 2010

(54) MULTIPLE SLOT TERMINAL

(75) Inventors: Todd R. Peterson, New Boston, MI (US); Ramon B. Jaramillo, Sterling Heights, MI (US); Ketan Adhvaryu, Sterling Heights, MI (US)

(73) Assignee: BorgWarner Inc., Auburn Hills, MI (US)

( * ) Notice: Subject to any disclaimer, the term of this patent is extended or adjusted under 35 U.S.C. 154(b) by 5 days.

(21) Appl. No.: 12/087,613

(22) PCT Filed: Feb. 8, 2007

(86) PCT No.: PCT/US2007/003361

§ 371 (c)(1),
(2), (4) Date: Jul. 10, 2008

(87) PCT Pub. No.: WO2007/092554

PCT Pub. Date: Aug. 16, 2007

(65) Prior Publication Data

US 2009/0047837 A1 Feb. 19, 2009

Related U.S. Application Data

(60) Provisional application No. 60/771,319, filed on Feb. 8, 2006.

(51) Int. Cl.
*H01R 11/11* (2006.01)

(52) U.S. Cl. ..... 439/857

(58) Field of Classification Search ..... 439/857, 439/862, 849, 842, 747
See application file for complete search history.

(56) References Cited

U.S. PATENT DOCUMENTS

| | | | | |
|---|---|---|---|---|
| 1,434,643 | A | 11/1922 | Woolson | |
| 2,510,697 | A | 6/1950 | Jacoby | |
| 4,445,393 | A | 5/1984 | Braun | |
| 4,527,857 | A | 7/1985 | Hughes et al. | |
| RE32,898 | E * | 4/1989 | Dechelette | 439/395 |
| 2006/0009326 | A1 | 1/2006 | Stefina | |

FOREIGN PATENT DOCUMENTS

| | | |
|---|---|---|
| DE | 10 2004 031021 | 1/2006 |
| EP | 0 849 510 | 6/1998 |
| GB | 734429 | 8/1955 |
| GB | 1 201 372 | 8/1970 |
| WO | WO 99/23723 | 5/1999 |

OTHER PUBLICATIONS

State Intellectual Property Office, P.R. China; First Office Action; Mar. 30, 2010; 15 pages.

* cited by examiner

*Primary Examiner*—Alexander Gilman
(74) *Attorney, Agent, or Firm*—Warn Partners, P.C.

(57) ABSTRACT

The present invention is directed to a dual terminal having first contact portion with an aperture formed through the first contact portion. A second contact portion, similar to the first contact portion and also has an aperture formed through the second contact portion and is arranged so that the aperture of the first contact portion and the aperture of the second contact portion are aligned. The dual terminal also has a circuit connector portion that is disposed between the first contact portion and the second contact portion and facilitates the electrical connection to the first contact portion and the second contract portion.

12 Claims, 2 Drawing Sheets

MULTIPLE SLOT TERMINAL

CROSS-REFERENCE TO RELATED APPLICATIONS

This application is a National Stage of International Application No. PCT/US2007/003361, filed Feb. 8, 2007. This application claims the benefit of U.S. Provisional Application No. 60/771,319, filed Feb. 8, 2006. The disclosures of the above applications are incorporated herein by reference.

FIELD OF THE INVENTION

The present invention is directed to a dual M-slot terminal design.

BACKGROUND OF THE INVENTION

M-slots (along with I/H slots) are mechanical connections that are used in the industry for creating an electrical connection. A typical M-slot has a female member (e.g., the M-slot terminal) that is configured for receiving a male terminal, known as a blade terminal. When the blade terminal is inserted into M-slot the electrical connection is complete. The use of the M-slot terminal provides a clean and reliable electrical connection for assembling a circuit, such as a lead frame to a device. M-slots are also ideal because their small design allows for smaller overall package size. An M-slot design does have disadvantages. For example, an M-slot has limited current carrying capacity. M-slot terminals also have a potential for vibration fatigue failures and can be highly sensitive to male terminal true position for assembly. In other words, the male terminal must be properly aligned with the M-slot during assembly in order to ensure that a proper connection is made.

SUMMARY OF THE INVENTION

The present invention is directed to a dual terminal having a first contact portion with an aperture formed through the first contact portion. There is also a second contact portion, similar to the first contact portion which has an aperture formed through the second contact portion. The first and second contact portions are arranged so that the aperture of the first contact portion and the aperture of the second contact portion are aligned. The dual terminal also has a circuit connector portion that is disposed between the first contact portion and the second contact portion and facilitates the electrical connection to the first contact portion and the second contact portion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
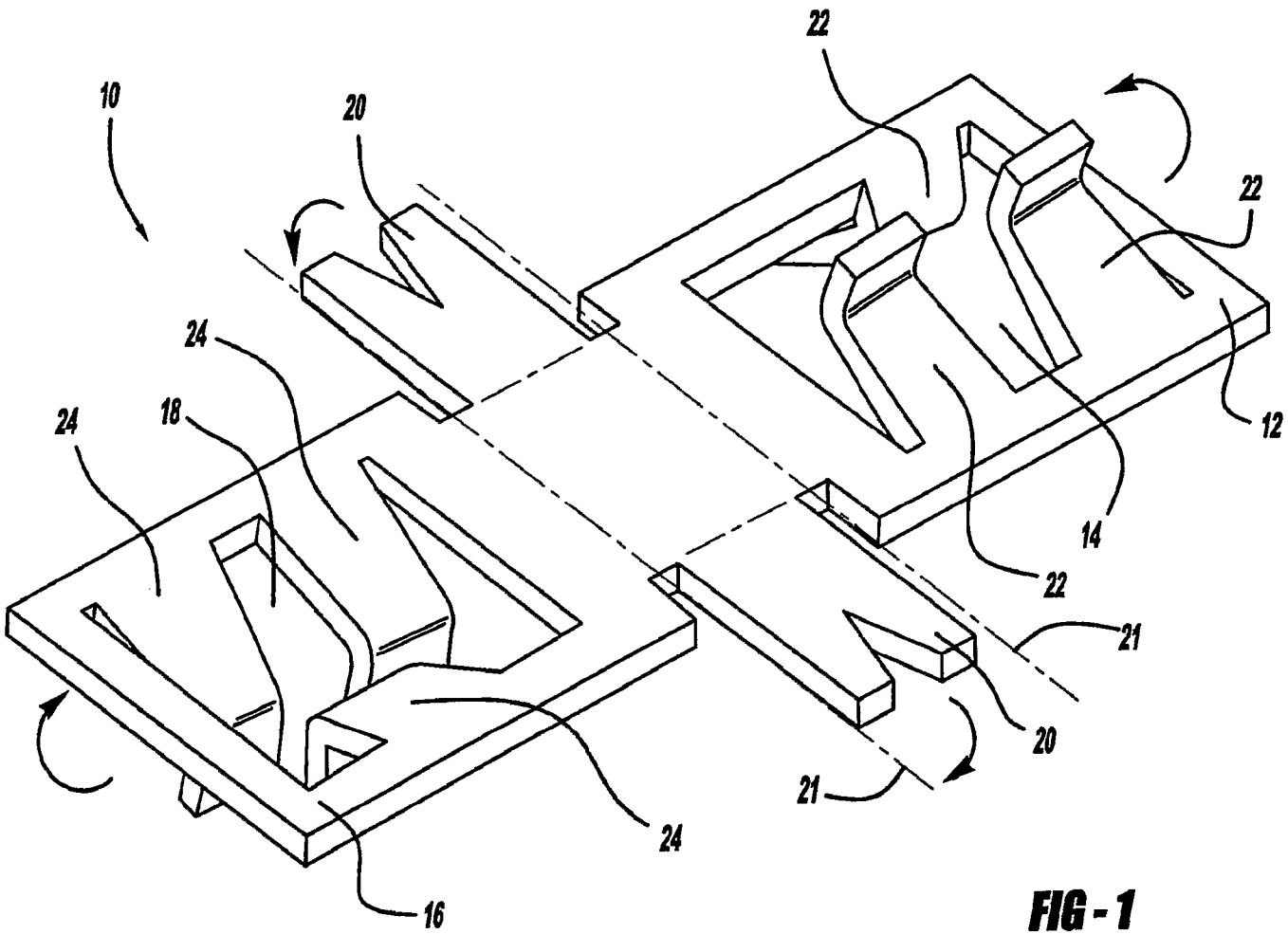
FIG. 1 is an overhead plan view of an unfolded dual terminal.
Figure 2:
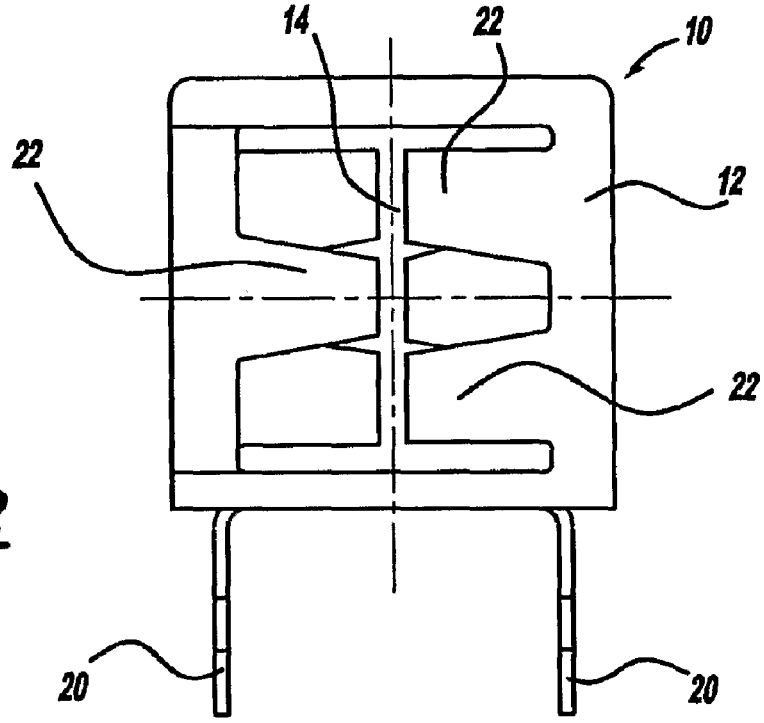
FIG. 2 is an overhead plan view of the first contact portion of the dual terminal.
Figure 3:
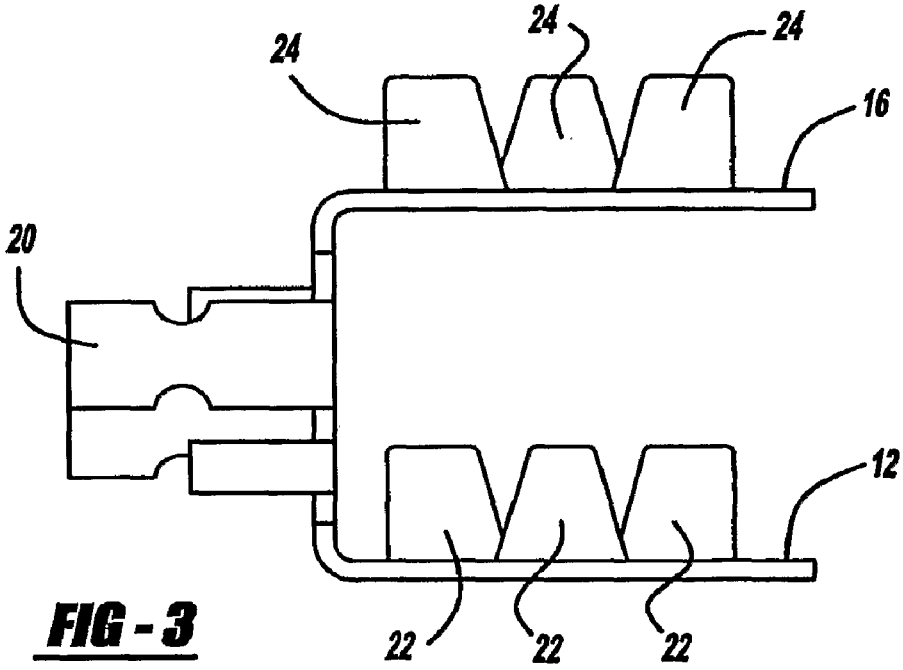
FIG. 3 is a side view of the U shaped dual terminal.

Referring now to FIGS. 1-3 a dual terminal 10 is shown. The dual terminal 10 described herein uses M-Slot terminals, however it is possible to use this design in other terminals that would benefit from an increased contact surface area. The dual terminal 10 can be made from a single metal sheet which is folded to form the dual terminal structure as shown in FIGS. 2 and 3. The dual terminal 10 has a first contact portion 12, which can be an M-Slot or an I/H Slot. The first contact portion 12 has an aperture 14 having flanges 22 extending into the aperture 14 for creating a female portion of the M-Slot terminal. The flanges 22 can be bent to allow the aperture 14 to slidably receive a blade terminal of a device. The flanges 22 are resilient and will hold the blade terminal in position within the aperture 14.

A second contact portion 16 also has an aperture 18 with flanges 24 extending into the aperture 18 also forming a. female portion of the M-Slot. The second contact terminal 16 together with the flanges 24 are configured to slidably receive a blade terminal and the flanges 24 act as resilient members for holding the blade terminal in position.

The first contact portion 12 and second contact portion 16 are aligned so that the apertures 14 and 18 are in alignment. Thus, the blade terminal when connected to the dual terminal 10 will extend through the aperture 14 of the first connector 12 and into the aperture 18 of the second connector 16. This provides twice the amount of contact surface area between the blade terminal and the dual terminal 10 than would normally be provided for a single M-Slot terminal. The greater contact surface area also allows for the blade terminal to be held more tightly to the dual terminal 10. The use of the dual terminal 10 permits a greater amount of current to be processed through the dual terminal 10 since the contact surface area is now roughly two times the contact surface of a single M-Slot design. Also the use of two of the dual terminal 10 design minimizes the possibility of the blade terminal losing its connection due to vibration.

Between the first contact portion 12 and second contact portion 16 is a circuit connector portion 20 that connects the first and second contact portions 12, 16. The circuit connector portion 20 can be soldered to a circuit, such as a lead frame, wire or other suitable medium so that the first and second contact portions 12, 16 can be electrically connected to a circuit. It is also within the scope of this invention for the circuit connector portion 20 to be connected to a circuit through some other means besides soldering, for example, the circuit connector portion 20 could be integrally formed to a lead frame circuit.

The overall shape of the dual terminal 10 once it has been formed, will have a U shape.

The circuit connector portion 20 along with either one or both of the first and second contact portions 12, 16 can be molded into a plastic form. This will help to insulate the first and second contact portions 12, 16 as well as the circuit connector portion 20 from possible short circuits.

In order to form the finished dual terminal 10 shown in FIGS. 2 and 3 the first contact portion and second contact portion are folded about dashed lines 21 in the direction shown by the arrow. The circuit connector portions 20 are folded in the opposite direction of the first and second contact portions 12, 16.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A dual terminal comprising:

a first contact portion having a first closed aperture formed through said first contact portion;

a second contact portion having a second closed aperture formed through said second contact portion, wherein said first contact portion and said second contact portion are positioned so that said first closed aperture of said first contact portion is aligned with said second closed aperture of said second contact portion wherein both of said first closed aperture and said second closed aperture provide a gripping contact with a blade terminal; and a circuit connector portion disposed substantially perpendicular to and between said first contact portion and said second contact portion wherein said connector portion connects said first contact portion and said second contact portion wherein the dual terminal being configured to be connected to a blade terminal which is disposed perpendicularly to and through said first closed aperture and the second closed aperture.

2. The dual terminals of claim 1 wherein said first contact portion and said second portion are M-slot terminals.

3. The dual terminals of claim 1 wherein said dual terminal is arranged in the shape of a U wherein said second contact portion is positioned below said first contact portion in a generally parallel manner and said circuit connector portion extends between said first and second contact portions at a generally perpendicular angle.

4. The dual terminal of claim 1 wherein said dual terminal is formed of a single metal sheet.

5. The dual terminal of claim 1 further comprising a device terminal extending through said first aperture of said first contact portion into said second aperture of said second contact portion wherein said device terminal is electrically connected to said first contact portion and said second contact portion.

6. The dual terminal of claim 1 wherein said circuit connector portion is soldered to a lead frame and is held in place by a plastic form.

7. The dual terminal of claim 6 wherein said first portion is held in place by said plastic form.

8. A dual terminal comprising:

a first contact portion having a first closed aperture with two or more flanges positioned in said first aperture of said first contact portion to form a clip;

a second contact portion having a second closed aperture with two or more flanges forming a clip within said second aperture of said second contact portion, wherein said first contact portion and said second contact portion are positioned so said first aperture of said first contact portion is aligned with said second aperture of said second contact portion wherein both of said first closed aperture and said second closed aperture provide a gripping contact with a blade terminal;

a circuit connector portion positioned between and connecting said first contact portion and said second contact portion; wherein the dual terminal being configured to be connected to a blade terminal which is disposed substantially perpendicular to and through said first closed aperture of said first contact member and extending into said second aperture of said second closed contact member.

9. The dual terminal of claim 8 wherein said dual terminal is arranged in the shape of a U wherein said second contact portion is positioned below said first contact portion in a generally parallel manner and said circuit connector portion extends between said first and second contact portions at a generally perpendicular angle.

10. The dual terminal of claim 8 wherein said dual terminal is formed of a single metal sheet.

11. The dual terminal of claim 8 wherein said circuit connector is connected to a lead frame and said circuit connector is held in place by a plastic form which supports said lead frame.

12. The dual terminal of claim 11 wherein said first contact portion is also held in position within said plastic form.

* * * * *

UNITED STATES PATENT AND TRADEMARK OFFICE

CERTIFICATE OF CORRECTION

PATENT NO. : 7,771,243 B2
APPLICATION NO. : 12/087613
DATED : August 10, 2010
INVENTOR(S) : Peterson et al.

It is certified that error appears in the above-identified patent and that said Letters Patent is hereby corrected as shown below:

On The Title page,
Item [57], Abstract, "second contract portion." should be -- second contact portion. --.

In The Specifications:
Column 2,
Line 22, "a. female" should be -- a female --.

In The Claims:
Column 4,
Line 25/26, Claim 8, "second aperture" should be -- second closed aperture --.

Column 4,
Line 26, Claim 8, "second closed contact member" should be -- second contact member --.

Signed and Sealed this

Fourteenth Day of December, 2010

David J. Kappos

David J. Kappos
*Director of the United States Patent and Trademark Office*